US008823263B2

(12) United States Patent
Andre

(10) Patent No.: US 8,823,263 B2
(45) Date of Patent: Sep. 2, 2014

(54) MICROWAVE TUBE WITH DEVICE FOR EXTRACTING IONS PRODUCED IN THE TUBE

(75) Inventor: Frédéric Andre, Clamart (FR)

(73) Assignee: Thales, Neuilly-sur-Seine (FR)

( * ) Notice: Subject to any disclaimer, the term of this patent is extended or adjusted under 35 U.S.C. 154(b) by 448 days.

(21) Appl. No.: 13/120,069

(22) PCT Filed: Aug. 24, 2009

(86) PCT No.: PCT/EP2009/060856

§ 371 (c)(1),
(2), (4) Date: Jun. 13, 2011

(87) PCT Pub. No.: WO2010/031655

PCT Pub. Date: Mar. 25, 2010

(65) Prior Publication Data

US 2011/0266951 A1 Nov. 3, 2011

(30) Foreign Application Priority Data

Sep. 19, 2008 (FR) ..... 08 05154

(51) Int. Cl.
*H01J 25/16* (2006.01)

(52) U.S. Cl.
USPC ..... 315/5.13; 315/5.14; 315/5.53; 315/39.51

(58) Field of Classification Search
USPC ..... 315/5.13
See application file for complete search history.

(56) References Cited

U.S. PATENT DOCUMENTS 2,963,605 A * 12/1960 Jepsen et al. ..... 313/399
4,489,254 A * 12/1984 Koinuma et al. ..... 315/39.51
6,310,438 B1 * 10/2001 Tsuida et al. ..... 315/3.5
7,071,624 B2 * 7/2006 Tsuchida ..... 315/3.5

* cited by examiner

*Primary Examiner* — Alexander H Taningco
*Assistant Examiner* — David Lotter
(74) *Attorney, Agent, or Firm* — Baker & Hostetler LLP

(57) ABSTRACT

An electron tube includes: a microwave structure having an evacuated envelope including two ends, the microwave structure being at a reference potential, an electron gun including a cathode for providing a beam of electrons, along an axis, at one end of the evacuated envelope, an electron collector for gathering electrons of the beam at the other end of the evacuated envelope, and at least one high-voltage power supply for applying to the cathode a negative high-voltage potential with respect to the reference potential. The tube includes between the cathode and the microwave structure a device for extracting the positive ions including at least one electrode carried to a negative potential with respect to the reference potential so as to extract positive ions from the evacuated envelope, these positive ions being produced by the impacting of the electrons of the electron beam with molecules of residual gas in the evacuated envelope. The invention has application to microwave electron tubes, klystron TWT etc. using a cylindrical electron beam.

10 Claims, 3 Drawing Sheets

MICROWAVE TUBE WITH DEVICE FOR EXTRACTING IONS PRODUCED IN THE TUBE

CROSS-REFERENCE TO RELATED APPLICATIONS

This application is a National Stage of International patent application PCT/EP2009/060856, filed on Aug. 24, 2009, which claims priority to foreign French patent application No. FR 0805154, filed on Sep. 19, 2008, the disclosures of which are incorporated by reference in their entirety.

FIELD OF THE INVENTION

The invention relates to microwave tubes with linear electron beam and notably to a device for extracting positive ions produced in the tube.

BACKGROUND

Linear-beam microwave tubes such as traveling-wave tubes (acronym TWT) or klystrons essentially comprise an electron gun having a cathode providing a cylindrical beam of electrons in an evacuated cylindrical envelope of a microwave structure of the tube. A collector, at one end of the microwave structure, gathers the electrons of the beam output by the cylindrical envelope.

The electrons output by the cathode are focused in the form of a linear beam in the evacuated cylindrical envelope by means of a magnetic field. This magnetic field may be created either by permanent magnets, or by windings around the evacuated cylindrical envelope.

The microwave structure is the element of the tube where an interaction takes place between the electron beam and an electromagnetic wave which may be, either applied to a radiofrequency input (RF) of the tube in the case of amplifier tubes, or created in the tube in the case of tubes operating as microwave oscillators. More precisely the beam of electrons yields part of its kinetic energy to the electromagnetic wave in the microwave structure.

The microwave structure comprises resonant cavities and drift tubes in the case of a klystron and of a helix or coupled cavities in the case of a TWT.

The vacuum inside an electron tube is never perfect and gas molecules present in the evacuated envelope of the tube pass into the beam and lose electrons (phenomenon of ionization) under the impact of the electrons of the beam which are very energetic (typically several Kev). Positive ions are thus formed in the beam. The positive charges being attracted by the negative charges of the beam, the positive ions remain locked in the beam in a position of radial equilibrium.

FIG. 1 shows an axial portion of a helix amplifier TWT of the state of the art.

The TWT of FIG. 1 comprises a microwave structure 10 having, along a longitudinal axis ZZ' of the tube, an evacuated envelope 12 containing a helix 14 traversed along this axis ZZ' by a cylindrical electron beam 16 propagating from the cathode to the anode of the tube. The direction of propagation of the beam is represented by the arrows B in FIG. 1.

The microwave structure 10 comprises, in a known manner, permanent magnets separated by magnetic spacers (not represented in the figure) so as to provide a confinement field for focusing the beam 16 on the axis ZZ' of the evacuated envelope. An RF input ensures an RF connection of the helix of the TWT with for example an external RF source.

As has been described above, the gas molecules passing into the electron beam that are struck by electrons of said beam produce positive ions 20 which move slowly, for example, from the cathode (not represented in FIG. 1) side of the tube.

The axial force acting on these positive ions 20 is very weak and they may remain in the beam 16 for a very long time before their slow drift velocity removes them, either toward the cathode, or toward the collector of the tube. Consequently, a large quantity of ions may accumulate inside the beam 16 and generate a significant positive space charge that may compromise good focusing of the beam. This concentration of positive ions in the beam results in a periodic focusing instability, called ion relaxation. This is a nuisance phenomenon which disturbs the RF telecommunication signal, for example in the case of an amplifier of TWT type, and which one seeks to eliminate.

The positive ions produced by the impacting of the electrons of the beam with the gas molecules in the evacuated envelope, in addition to the ion relaxation phenomenon, present another drawback. Indeed, when these ions arrive, after their long journey in the beam, level with the cathode of the tube, the negative potential of the cathode attracts them, producing impacts on the cathode and a deterioration of its emissive surface by a phenomenon of ion erosion or "sputtering".

To eliminate the impact of the positive ions on the cathode of the tube, state-of-the-art electron tubes are equipped with a device designated by the term "ion barrier". The ion barrier is an electrode placed after the cathode and carried to a positive potential so as to repel or reflect the positive ions originating from the beam. The drawback of the ion barrier is that it aggravates the ion relaxation described above, disturbing yet more strongly the RF signal in the tube. Indeed the positive ions can no longer be removed via the cathode and spend more time in the electron beam.

SUMMARY OF THE INVENTION

In order to alleviate the drawbacks of the microwave electron tubes of the state of the art, the invention proposes an electron tube comprising:

- a microwave structure having an evacuated envelope comprising two ends, the microwave structure being at a reference potential (E),
- an electron gun comprising a cathode for providing a beam of electrons, along an axis ZZ', at one end of the evacuated envelope,
- an electron collector for gathering electrons of the beam at the other end of the evacuated envelope,
- at least one high-voltage power supply for applying to the cathode a negative high-voltage potential with respect to the reference potential, the electron tube comprises, between the cathode and the microwave structure, a device for extracting positive ions comprising at least one electrode e2 carried to a negative potential with respect to the reference potential so as to extract positive ions from the evacuated envelope, these positive ions being produced by the impacting of the electrons of the electron beam with molecules of residual gas in the evacuated envelope.

Advantageously, the device for extracting positive ions comprises another electrode e1 forming with the electrode e2 a pair of electrodes e1, e2, the electrodes of the pair facing one another on either side of the electron beam, the other electrode e1 of the pair being carried to the reference potential, the electrode e2 being carried to the negative potential (Vp) with respect to the reference potential so as to create between the two electrodes an ion-extracting electric field.

In one embodiment, the electrodes facing one another comprise plane surfaces parallel to a plane passing through the axis ZZ' creating a passage for the electron beam.

In another embodiment, each electrode e1, e2, of the pair has a cylindrical half-plate shape, the two electrodes being symmetric on either side of the axis ZZ'.

In another embodiment, the plane surfaces parallel to the plane passing through the axis ZZ' are separated by a distance De on either side of this axis ZZ' so as to allow the electron beam of the tube to pass through.

In another embodiment, the electron tube comprises other devices for extracting positive ions along the electron beam in the evacuated envelope.

In another embodiment, the reference potential is the earth potential of the tube.

In another embodiment, the negative potential of the other electrode e2 is typically 100 volts below the electrical earth of the tube.

A main objective of the invention is to make microwave tubes eliminating the ion relaxation phenomenon by removing positive ions from the tube.

Another objective is to protect the cathode of the tube against impacts by the positive ions.

Another objective of the invention is to shift the impacts by the ions extracted from the tube onto a predetermined surface chosen by the tube designer.

BRIEF DESCRIPTION OF THE DRAWINGS

The invention will be better understood via the description of a microwave tube according to the invention via indexed figures in which.

DETAILED DESCRIPTION

Figure 1:
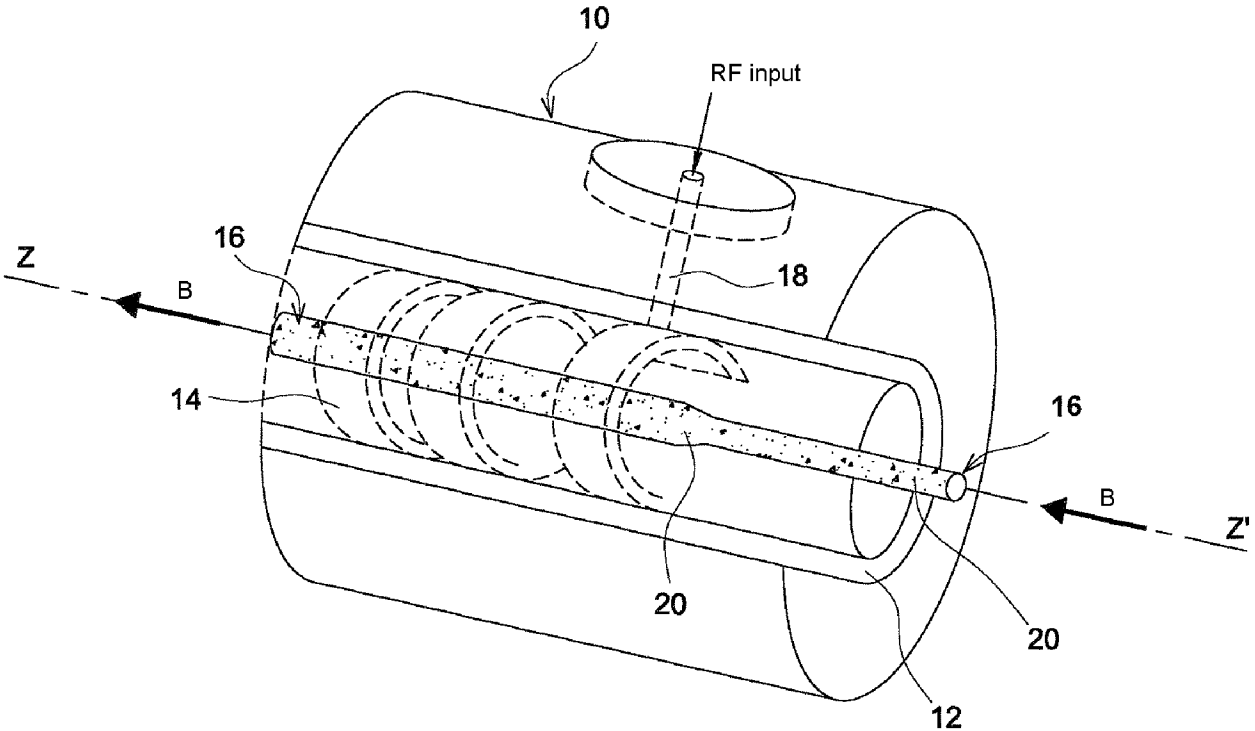
FIG. 1, already described, shows an axial portion of a helix amplifier TWT of the state of the art.
Figure 2:
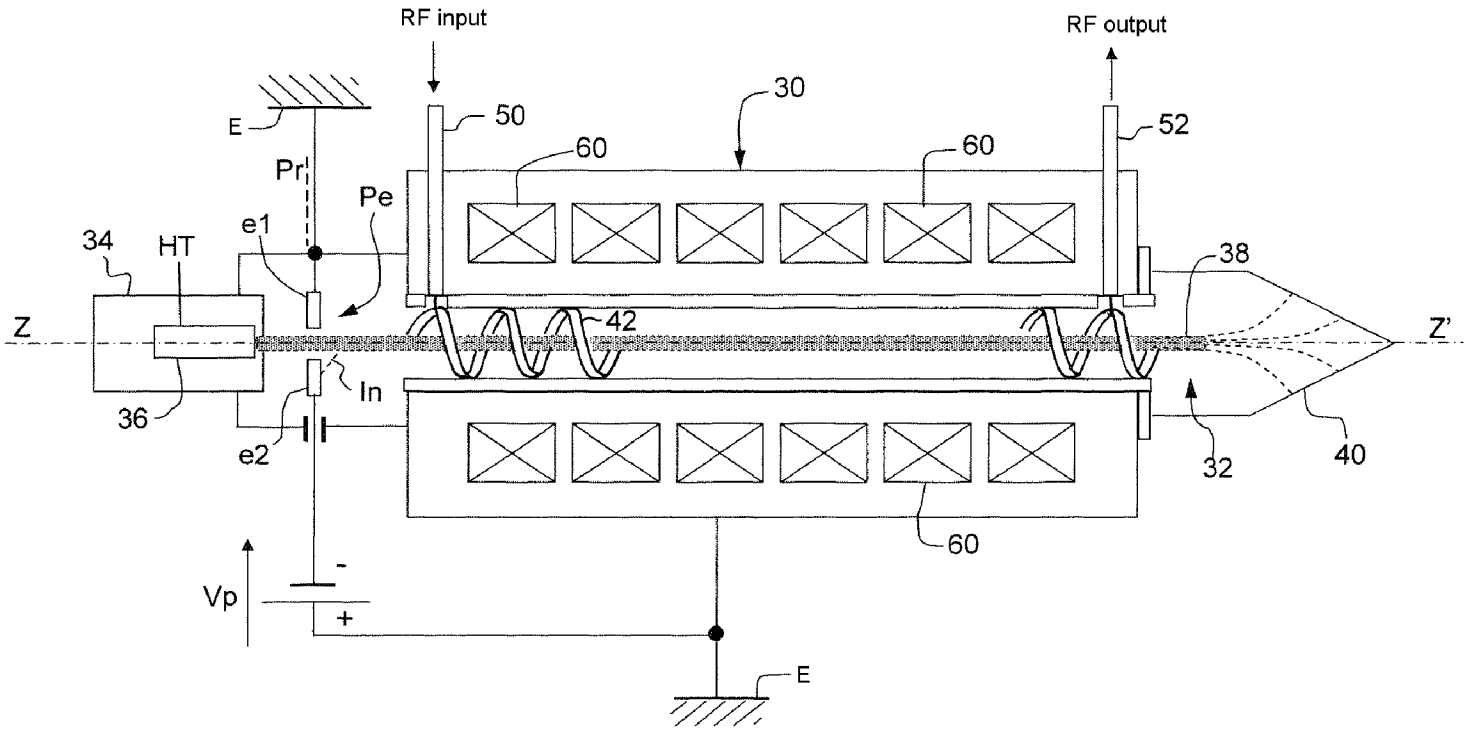
FIG. 2 represents a basic diagram of a microwave tube according to the invention comprising a device for extracting positive ions.

FIG. 2 represents a basic diagram of a microwave tube according to the invention comprising a device for extracting positive ions. In this exemplary embodiment the microwave tube is a helix traveling-wave tube or TWT.

The microwave tube of FIG. 2 comprises a microwave structure 30 along a longitudinal axis ZZ' containing an evacuated cylindrical envelope 32 having two ends.

An electron gun 34 comprising a cathode 36 at a high-voltage potential HT that is negative with respect to an earth E of the tube (reference potential) provides a cylindrical beam of high-velocity electrons 38 along the axis ZZ' at one of the ends of the evacuated cylindrical envelope.

The tube comprises a collector 40 for gathering the electrons output by the microwave structure 30, at the other end of the evacuated cylindrical envelope.

The evacuated cylindrical envelope 32 comprises a helix 42 along the axis ZZ', acting as waveguide. In the exemplary embodiment of FIG. 2, the TWT is an RF amplifier comprising an RF input 50 connected to one of the ends of the helix, on the cathode 34 side, and an RF output 52 connected to the other end of the helix on the collector 40 side.

The microwave structure 30 of the TWT comprises, around the axis ZZ', coils 60 providing a magnetic confinement field for focusing the electron beam 38 along the axis ZZ'.

The device for extracting positive ions from the microwave tube of FIG. 2 comprises a pair Pe of electrodes (ion purge) between the cathode 36 and one end of the microwave structure 30, on the cathode 36 side.

Each electrode of the pair Pe is in one and the same radial plane Pr perpendicular to the axis ZZ' of the tube.

The device for extracting positive ions comprises a first electrode el linked to the earth E of the tube and according to a main characteristic of the invention, a second electrode e2 linked to a potential Vp which is negative with respect to the earth of the tube. This negative potential Vp is also designated by ion purge potential.

The ion purge potential Vp applied to the second electrode e2 is typically 100 volts below the electrical earth E of the tube, but this voltage Vp may be of significantly different value as a function of the chosen spacing between the electrodes of the device for extracting positive ions.

The positive ions In arriving in proximity to the pair Pe of electrodes e1, e2 are extracted from the beam 38 laterally. The ions In in the electron beam 38 take a radial velocity which extracts them from the beam toward the second electrode e2, also designated by ion purge electrode, and moves them away from the axis ZZ'.

The ions In, in this configuration according to the invention, are projected onto a tube surface chosen by the tube designer thus avoiding their projection onto the cathode 36 and consequently eliminating the erosion of the cathode (sputtering).

Figure 3:
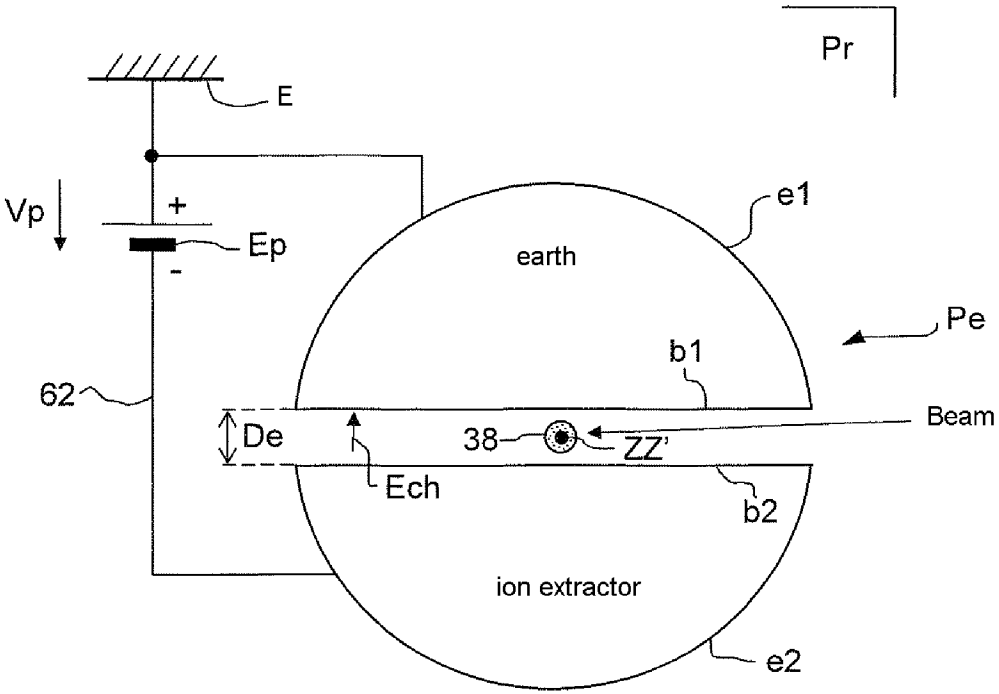
FIG. 3 shows an axial view of the tube extraction device of FIG. 2 according to the invention.

FIG. 3 shows an axial view of the tube extraction device of FIG. 2 according to the invention.

The axial view of FIG. 3 shows the pair Pe of electrodes e1, e2 in the plane Pr perpendicular to the axis ZZ' of the microwave structure of the TWT of FIG. 2.

Each electrode e1, e2 of the pair Pe has a cylindrical half-plate shape, the two electrodes e1, e2 being symmetric on either side of the axis ZZ' of the evacuated envelope, each comprising a rectilinear edge b1, b2 in the form of a plane surface. The plane surfaces of the rectilinear edges of the cylindrical half-plates are parallel and separated by a distance De on either side of this axis ZZ' so as to allow the electron beam of the tube to pass through.

The electrode e1 is linked to the earth of the tube and the electrode e2 (or ion extractor) is linked to a source Ep providing the negative potential Vp with respect to this earth E.

The positive ions in the beam of electrons passing between the two half-plates e1, e2 are attracted by the negative potential Vp when they arrive in proximity to the electrode e2 (or to the ion extractor). The negative ions extracted from the electron beam 38 pass through the half-plate e2 and are conducted by the electrical connection 62 linking the half-plate e2 to the source Ep of negative potential Vp toward an ion projection surface determined by the tube designer (surface not represented in FIG. 3).

As represented in FIG. 3 the non-axisymmetric shape of the pair Pe of electrodes makes it possible to generate between the straight edges b1, b2 of the two electrodes e1, e2 a static electric field Ech whose component perpendicular to the axis of the electron beam is nonzero. The positive ions of the beam take a radial velocity which extracts them from the beam and moves them away from the axis ZZ' of the tube.

The positive ions are projected onto the projection surface chosen by the designer and on which the sputtering does not endanger the operation of the tube.

The electrostatic field produced by the electrodes e1, e2 is too weak to significantly influence the trajectories of the electrons of the electron beam of the tube, only the trajectories of the positive ions are deviated.

The device for extracting positive ions according to the invention removes the positive ions from the beam thus appreciably reducing the problem of ion relaxation and makes it possible to choose the ion impact surface thereby avoiding erosion of the sensitive surfaces of the tube, and notably that of the cathode, endangering the operation of the tube.

In other embodiments of the electron tube according to the invention, the evacuated envelope can comprise several ion purges, either several pairs of electrodes for extracting positive ions along the trajectory of the electron beam, or along the axis ZZ', so as to more effectively eliminate the influence of the positive ions in the microwave tube.

The exemplary TWT described is not limiting and the invention can be applied to other types of electron tubes, shapes of evacuated envelopes and electron beams. For example in certain electron tubes the electron beam may be of rectangular cross section.

The invention applies to electron tubes comprising either a hot cathode or a cold cathode.

The axis ZZ' is, in other electron tubes, the output axis for the electrons that can propagate thereafter in other directions in microwave structures of various shapes according to the applications.

The invention claimed is:

1. An electron tube comprising:

a microwave structure (10, 30) having an evacuated envelope (12, 32) comprising two ends, the microwave structure being at a reference potential (E), an electron gun (34) comprising a cathode (36) for providing a beam (16, 38) of electrons, along an axis ZZ', at one end of the evacuated envelope, an electron collector (40) for gathering electrons of the beam at the other end of the evacuated envelope, at least one high-voltage power supply for applying to the cathode (36) a negative high-voltage potential (HT) with respect to the reference potential (E), between the cathode (36) and the microwave structure, a device (Pe) for extracting positive ions comprising at least one electrode e2 carried to a negative potential (Vp) with respect to the reference potential (E) so as to extract positive ions (In) from the evacuated envelope, these positive ions being produced by the impacting of the electrons of the electron beam with molecules of residual gas in the evacuated envelope, wherein the device for extracting positive ions comprises another electrode el forming with the electrode e2 a pair (Pe) of electrodes e1, e2, the electrodes of the pair facing one another on either side of the electron beam, the other electrode el of the pair being carried to the reference potential (E), the electrode e2 being carried to the negative potential (Vp) with respect to the reference potential (E) so as to create between the two electrodes an ion-extracting electric field (Ech), wherein each electrode e1, e2 of the pair (Pe) has a cylindrical half-plate shape, the two electrodes being symmetric on either side of the axis ZZ'.

2. The electron tube as claimed in claim 1, wherein the electrodes facing one another further comprise plane surfaces (b1, b2) parallel to a plane passing through the axis ZZ' creating a passage for the electron beam (38).

3. The electron tube as claimed in claim 2 wherein the plane surfaces (b1, b2) parallel to the plane passing through the axis ZZ' are separated by a distance De on either side of this axis ZZ' so as to allow the electron beam of the tube to pass through.

4. The electron tube as claimed in claim 1 further comprising, one or more devices for extracting positive ions along the electron beam in the evacuated envelope.

5. The electron tube as claimed in claim 1 wherein the reference potential (E) has an earth potential of the tube.

6. The electron tube as claimed in claim 1 wherein the negative potential (Vp) of the electrode e2 is 100 volts below the electrical earth (E) of the tube.

7. The electron tube as claimed in claim 2, wherein each electrode e1, e2 of the pair (Pe) has a cylindrical half-plate shape, the two electrodes being symmetric on either side of the axis ZZ'.

8. The electron tube as claimed in claim 1, further comprising other devices for extracting positive ions along the electron beam in the evacuated envelope.

9. The electron tube as claimed in claim 3, further comprising other devices for extracting positive ions along the electron beam in the evacuated envelope.

10. The electron tube as claimed in claim 1, wherein sides on which electrodes e1, e2, face each other are configured to be, at least in part, parallel to the axis ZZ'.

* * * * *